United States Patent [19]

Kanamori

[11] Patent Number: 5,021,181

[45] Date of Patent: Jun. 4, 1991

[54] WATER-GLYCOL HYDRAULIC FLUID

[75] Inventor: Hideo Kanamori, Ichihara, Japan

[73] Assignee: Idemitsu Kosan Co., Ltd., Tokyo, Japan

[21] Appl. No.: 420,538

[22] Filed: Oct. 12, 1989

[30] Foreign Application Priority Data

Oct. 31, 1988 [JP] Japan ..... 63-273132

[51] Int. Cl.[5] ..... C10M 173/02; C10M 145/12

[52] U.S. Cl. ..... 252/75; 252/49.3; 252/77; 252/79

[58] Field of Search ..... 252/75, 76, 77, 79, 252/49.3

[56] References Cited

U.S. PATENT DOCUMENTS 2,751,355 6/1956 Clark ..... 252/75

3,580,847 5/1971 Boehmer et al. ..... 252/75

3,992,312 11/1976 Genjida et al. ..... 252/77

4,855,070 8/1989 Lewis ..... 252/75

*Primary Examiner*—Paul Lieberman

*Assistant Examiner*—Christine A. Skane

*Attorney, Agent, or Firm*—Antonelli, Terry, Stout & Kraus

[57] ABSTRACT

A water-glycol hydraulic fluid comprising a higher aliphatic acid in a ratio of 2 to 15% by weight, alkali hydroxide in an amount less than an equivalent amount of the higher aliphatic acid, and an organic alkaline compound containing nitrogen atoms in an amount sufficient to adjust the pH of the whole fluid to 10 to 12 is disclosed.

This hydraulic fluid has excellent wear resistance and also excellent sludge solubility.

6 Claims, No Drawings

WATER-GLYCOL HYDRAULIC FLUID

BACKGROUND OF THE INVENTION

1. Field of the Invention

The present invention relates to a water-glycol hydraulic fluid, or more particularly to a water-glycol hydraulic fluid having high wear resistance and excellent sludge solubility.

2. Description of the Prior Arts

In general, water-glycol hydraulic fluid is widely used as hydraulic fluid for various kinds of equipment such as hydraulic instruments since it is fire resistant or flame retardance. But it has a problem such that its wear resistance is unsatisfactory. It is known that an aliphatic acid can be mixed to the water-glycol hydraulic fluid in order to solve the problem. For example, Japanese Patent Publication No. 59159/1987 discloses that a higher unsaturated aliphatic acid and a higher saturated aliphatic acid are used in combination, and alkali hydroxide in an amount of more than the neutralization equivalent amount is mixed therein to prepare a water-glycol hydraulic fluid with improved wear resistance.

However, in the water-glycol hydraulic fluid with improved wear resistance by addition of a higher unsaturated aliphatic acid, the higher unsaturated aliphatic acid is liable to be deteriorated, and as a result, sludge solubility of the hydraulic fluid is lowered to precipitate a solid material dissolved therein in some cases.

SUMMARY OF THE INVENTION

An object of the present invention is to provide a water-glycol hydraulic fluid with improved wear resistance. Another object of the present invention is to provide a water-glycol hydraulic fluid with excellent sludge solubility as well as improved wear resistance.

The present invention provides a water-glycol hydraulic fluid which comprises a higher aliphatic acid in the ratio of 2 to 15% by weight, alkali hydroxide in an amount less than an equivalent amount of said higher aliphatic acid and an organic alkaline compound containing nitrogen atoms in an amount sufficient to adjust the pH to 10 to 12 in the water-glycol hydraulic fluid containing water and glycol.

DESCRIPTION OF THE PREFERRED EMBODIMENTS

The mixing ratio of water and glycol in the water-glycol fluid of the present invention is not limited and can be properly determined depending on various conditions. For example, the ratio of water is 30 to 70% by weight and the ratio of glycol is 70 to 30% by weight. Further if desired, a viscosity adjusting agent to adjust the viscosity of the hydraulic fluid can be added thereto in an amount of 5 to 60 parts by weight based on 100 parts by weight of the total of said water and glycol.

As the above-described glycols, there can be cited monoethylene glycol, diethylene glycol, triethylene glycol, monopropylene glycol, dipropylene glycol, tripropylene glycol, monohexylene glycol, dihexylene glycol, trihexylene glycol, etc., and these can be used singly or in combination. In general, it is preferable to use mono- or di-propylene glycol.

Also, as a viscosity adjusting agent, a copolymer of ethylene oxide (EO) and propylene oxide (PO) is usually used. The average molecular weight of this copolymer is suitably about 5,000 to 20,000, and further, the ratio of EO and PO in the copolymer is preferably 10:1 to 1:10 (mol ratio).

As the higher aliphatic acid to be added to the water-glycol liquid prepared as described above, there can be used various kinds of those used hitherto, for example, saturated aliphatic acid, unsaturated aliphatic acid, straight chain aliphatic acid, branched chain aliphatic acid and mixture thereof, as long as they have a carbon number of about 10 to 22. Among them, it is preferable to use a saturated aliphatic acid having a carbon number of 12 to 18, when viewing the aspect of the defoaming properties and solubility. The mixing ratio of the higher aliphatic acid is suitably 2 to 15% by weight based on the whole amount of the hydraulic fluid, and preferably 5 to 12% by weight. When it is less than 2% by weight, the hydraulic fluid obtained becomes deficient in wear resistance, and when it exceeds 15% by weight, the solubility in the water-glycol liquid becomes poor and there is a fear of separating out of the higher aliphatic acid itself.

Examples of alkali hydroxides include hydroxides of alkali metals, or more specifically, potassium hydroxide, sodium hydroxide, lithium hydroxide, etc. The mixing ratio of this alkali hydroxide is preferably adjusted to be less than an equivalent amount of the above-described higher aliphatic acid, and especially in such a manner as the mol ratio to the higher aliphatic acid becomes 0.95 to 0.995. When the mixing ratio is too small, the wear resistance becomes deficient, and the solubility of sludge also deteriorates. It is also the same in the case where the alkali hydroxide is added in an amount more than the equivalent amount of the higher aliphatic acid.

In the present invention, an organic alkaline compound containing nitrogen atoms is added together with the components described above. The amount of the organic alkaline compound may be an amount sufficient to regulate the pH of the whole system to be 10 to 12. This amount sufficient for regulating the pH of the whole system to 10 to 12 is different depending on various kinds of conditions, and can not be determined unconditionally, but usually it is determined in the range of 0.5 to 5% by weight based on the whole system.

When the pH of the whole system is less than 10, the sludge solubility deteriorates. On the other hand, when the pH exceeds 12, the wear resistance becomes poor. As the organic alkaline compound containing nitrogen atoms to be added for adjusting the pH, various kinds can be used. Typical examples are morpholine, cyclohexylamine, dicyclohexylamine, dimethylethanolamine and diethylethanolamine. In particular, morpholine and cyclohexylamine are preferred.

Further, for the water-glycol hydraulic fluid of the present invention, various kinds of additives can be added, if necessary, such as, metal deactivators, defoaming agents and coloring agents. Although the amount of these additives may be approximately the same as in the conventional cases, it is suitable to be in the range of 0.1 to 0.5% by weight as the total amounts. Examples of the metal deactivators include benzotriazole, methylbenzotriazole, mercaptobenzothiazole, benzothiazole, ethylenediaminetetraacetic acid (EDTA), EDTA disodium salt and EDTA tetrasodium salt. Among them, benzotriazole is preferred.

As explained above, the water-glycol hydraulic fluid of the present invention has excellent wear resistance, and has also excellent sludge solubility. Further, the appearance of the fluid after using for a long period of time is good, and the amount of foaming is small.

Therefore, according to the water-glycol hydraulic fluid of the present invention, the required exchange period of various parts of pump main bodied and filters and the like can be prolonged, and since it has excellent sludge solubility, the working damage of the instrument due to the precipitation of solid materials can be prevented.

Next, the present invention will be explained in more detail by referring to Examples and Comparative Examples.

EXAMPLES 1 TO 9 AND COMPARATIVE EXAMPLES 1 TO 4 sure was 70 kg/cm$^2$, the temperature 50° C., the rotation number 1200 r.p.m., and the operating time 250 hours.

Also, the evaluation as a hydraulic fluid was carried out on the basis of the total of the wearing amount of the vane and the cum ring of the pump, the generation or not of a floating substance (sludge), appearance, transparency, and foaming properties (according to JIS K2231). As to the appearance of the liquid, the one which is transparent and has no floating substances was marked as "O", the one in which a little floating substance was observed as "Δ", and the one in which a large amount of floating substances was observed as "x". pH is shown only for the ones in which adjustment was effected with morpholine.

TABLE

| No. | lauric acid (wt %) | oleic acid (wt %) | isostesric acid (wt %) | KOH (wt %) | KOH/aliphatic acid (mol ratio) (wt %) | morpholine | propylene glycol (wt %) | dipropylene glycol (wt %) | EO-PO copolymer (wt %) |
|---|---|---|---|---|---|---|---|---|---|
| Example 1 | 7.5 | — | — | 2.42 | 0.992 | 2.0 | — | 33.0 | 14.0 |
| Example 2 | 7.5 | — | — | 2.40 | 0.984 | 2.0 | — | 33.0 | 14.0 |
| Example 3 | 7.5 | — | — | 2.38 | 0.976 | 2.0 | — | 33.0 | 14.0 |
| Example 4 | 7.5 | — | — | 2.36 | 0.978 | 2.0 | — | 33.0 | 14.0 |
| Example 5 | 7.5 | — | — | 2.34 | 0.960 | 2.0 | — | 33.0 | 14.0 |
| Example 6 | 7.5 | — | — | 2.38 | 0.976 | 2.0 | 31.0 | — | 16.0 |
| Example 7 | 7.5 | — | — | 2.38 | 0.976 | 2.0 | — | 32.94 | 14.0 |
| Example 8 | — | 10.6 | — | 2.38 | 0.976 | 2.0 | — | 29.9 | 14.0 |
| Example 9 | — | — | 10.7 | 2.38 | 0.976 | 2.0 | — | 29.8 | 14.0 |
| Comparative Example 1 | 6.3 | 1.2 | — | 2.35 | 1.011 | 0.5 | 33.5 | — | 16.0 |
| Comparative Example 2 | 7.5 | — | — | 2.44 | 1.000 | 0.5 | — | 33.0 | 14.0 |
| Comparative Example 3 | 7.5 | — | — | 2.38 | 0.976 | — | — | 33.0 | 14.0 |
| Comparative Example 4 | 7.5 | 10.6 | — | 2.44 | 1.000 | 2.0 | — | 29.9 | 14.0 |

| No. | additive (wt %) | water | pH | wear amount (mg) | occurrence of sludge | appearance of the liquid | foaming properties |
|---|---|---|---|---|---|---|---|
| Example 1 | 0.06 | remainder | 10.9 | 23 | O | O | 10> ~0 |
| Example 2 | 0.06 | remainder | 10.8 | 21 | O | O | 10> ~0 |
| Example 3 | 0.06 | remainder | 10.6 | 12 | O | O | 10> ~0 |
| Example 4 | 0.06 | remainder | 10.5 | 15 | O | O | 10> ~0 |
| Example 5 | 0.06 | remainder | 10.4 | 37 | O | O | 10> ~0 |
| Example 6 | 0.06 | remainde | 10.6 | 7 | O | O | 30~0 |
| Example 7 | 0.12 | remainder | 10.6 | 8 | O | O | 10> ~0 |
| Example 8 | 0.06 | remainder | 10.6 | 18 | O | O | 40~10 |
| Example 9 | 0.06 | remainder | 10.6 | 10 | O | O | 10> ~0 |
| Comparative Example 1 | 0.15 | remainder | 10.3 | 58 | X | O | 30~0 |
| Comparative Example 2 | 0.06 | remainder | 10.5 | 780 | Δ | O | 20~0 |
| Comparative Example 3 | 0.06 | remainder | — | 280 | X | O | 10> ~0 |
| Comparative Example 4 | 0.06 | remainder | 10.5 | 1370 | X | O | 30~0 |

As shown in the following Table, lauric acid, oleic acid, and isostearic acid as the higher aliphatic acids, potassium hydroxide with purity of 86.0% by weight as the alkali hydroxide, morpholine as an organic alkaline compound containing nitrogen atoms, propylene glycol and dipropylene glycol as the glycol, and the above-described EO-PO copolymer (EO:PO=4:1, molecular weight of about 15,000), and further, metal deactivator, defoaming agent and coloring agent as various kinds of additives, were mixed with each other in weight percentage as shown in the Table to prepare a water-glycol hydraulic fluid.

Succeedingly, a pump test was carried out according to the ASTM D 2251, and the characteristics of the fluid was evaluated. A V-104C type pump was used, and the operating conditions were such that the pres-

I claim:

1. In a water-glycol hydraulic fluid containing water and glycol, the improvement which comprises a higher aliphatic acid having a carbon number of 10 to 22 in a ratio of 2 to 15% by weight based on the total weight of the hydraulic fluid, alkali hydroxide in an amount less than an equivalent amount of said higher aliphatic acid, and an organic alkaline compound containing nitrogen atoms selected from the group consisting of morpholine, cyclohexylamine, dicyclohexylamine, dimethyle thanolamine and diethylethanolamine in an amount sufficient to adjust to the pH of the whole fluid to 10 to 12; the mixing ratio of the alkali hydroxide to the higher aliphatic acid being 0.95 to 0.995 (mol ratio).

2. The water-glycol hydraulic fluid as defined in claim 1, containing ethylene oxide-propylene oxide copolymer with an average molecular weight of 5,000 to 20,000.

3. The water-glycol hydraulic fluid as defined in claim 2, wherein an amount of the ethylene oxide-propylene oxide copolymer is 5 to 60 parts by weight based on 100 parts by weight of the total amount of the water and the glycol.

4. The water-glycol hydraulic fluid as defined in claim 1, wherein the glycol is monoethylene glycol, diethylene glycol, triethylene glycol, monopropylene glycol, dipropylene glycol, tripropylene glycol, monohexylene glycol, dihexylene glycol or trihexylene glycol.

5. The water-glycol hydraulic fluid as defined in claim 1, wherein the higher aliphatic acid is a saturated aliphatic acid an unsaturated aliphatic acid a straight chain aliphatic acid or a branched chain aliphatic acid.

6. The water-glycol hydraulic fluid as defined in claim 1, wherein the glycol is monoethylene glycol, diethylene glycol, triethylene glycol, monopropylene glycol, dipropylene glycol, tripropylene glycol, monohexylene glycol, dihexylene glycol or trihexylene glycol; the higher aliphatic acid is a saturated aliphatic acid an unsaturated aliphatic acid a straight chain aliphatic acid or a branched chain alphatic acid.

* * * * *